US011584569B2

(12) United States Patent
Neputy

(10) Patent No.: US 11,584,569 B2
(45) Date of Patent: Feb. 21, 2023

(54) LOW WEIGHT CLOSURE HAVING AN IMPROVED GRIPPING SURFACE

(71) Applicant: Silgan White Cap LLC, Downers Grove, IL (US)

(72) Inventor: Darren Neputy, Palos Hills, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 762 days.

(21) Appl. No.: 16/537,250

(22) Filed: Aug. 9, 2019

(65) Prior Publication Data

US 2019/0359392 A1 Nov. 28, 2019

Related U.S. Application Data

(63) Continuation of application No. 15/451,738, filed on Mar. 7, 2017, now Pat. No. 10,407,220.

(51) Int. Cl.

| | |
|---|---|
| ***B65D 41/04*** | (2006.01) |
| ***B65D 41/34*** | (2006.01) |
| ***B65D 41/00*** | (2006.01) |
| ***B65B 7/28*** | (2006.01) |
| ***B67B 3/20*** | (2006.01) |

(52) U.S. Cl.

CPC ..... *B65D 41/0485* (2013.01); *B65B 7/2835* (2013.01); *B65D 41/005* (2013.01); *B65D 41/0421* (2013.01); *B65D 41/3447* (2013.01); *B67B 3/20* (2013.01); *B65D 2251/02* (2013.01); *B65D 2251/023* (2013.01)

(58) Field of Classification Search

None

See application file for complete search history.

(56) References Cited

U.S. PATENT DOCUMENTS

| | | | | |
|---|---|---|---|---|
| D124,384 | S | 4/1940 | Ehrlich | |
| 3,906,706 | A * | 9/1975 | Conti | B67B 3/2066 53/345 |
| 3,984,965 | A * | 10/1976 | Sonnenberg | B67B 3/2066 53/345 |
| 5,473,855 | A * | 12/1995 | Hidding | B65D 41/04 53/317 |
| D606,401 | S | 12/2009 | Kamath et al. | |
| 2002/0162818 | A1 * | 11/2002 | Williams | B65D 41/3447 215/349 |

(Continued)

*Primary Examiner* — Chinyere J Rushing-Tucker

(74) *Attorney, Agent, or Firm* — Reinhart Boerner Van Deuren s.c.

(57) ABSTRACT

A closure includes a top panel and a corner section connecting an outer periphery of the top panel with a downwardly extending annular skirt. A plurality of gently curved ridges are spaced about the outer perimeter of the closure. The ridges generally extend from a lower portion of the skirt and around the corner section, with the upper ends of the ridges terminating proximate the top panel outer periphery. A plurality of knurls extend radially outwards from the midpoints of the ridges along the skirt of the closure. The configuration, arrangement, and spacing of the ridges and knurls about the closure provide an enhanced grip and feel, allowing for easier twist-off of the closure from a container. The closure may be used interchangeably with existing capping chucks used to apply conventional closures without requiring any modification to the capping chucks to apply the closures to containers during a capping process.

20 Claims, 9 Drawing Sheets

(56) References Cited

U.S. PATENT DOCUMENTS

| | | | | |
|---|---|---|---|---|
| 2004/0200797 | A1 | 10/2004 | Hicks et al. | |
| 2008/0087625 | A1 | 4/2008 | Kumata et al. | |
| 2008/0105640 | A1* | 5/2008 | Ott | B65D 5/748 215/252 |
| 2012/0318768 | A1 | 12/2012 | Bashyam | |
| 2013/0313218 | A1 | 11/2013 | Cox et al. | |
| 2014/0311089 | A1* | 10/2014 | Scott | B67B 3/2066 53/331.5 |

* cited by examiner

LOW WEIGHT CLOSURE HAVING AN IMPROVED GRIPPING SURFACE

CROSS-REFERENCE TO RELATED PATENT APPLICATION

This application is a continuation of U.S. application Ser. No. 15/451,738, filed Mar. 7, 2017, which is incorporated herein by reference in its entirety.

BACKGROUND OF THE INVENTION

The present invention relates generally to the field of plastic closures for containers. The closures described and illustrated herein are configured for easier removal from a container. Furthermore, the closures are lower weight than conventional closures, and are configured to be used interchangeably with conventional closures without incurring substantial, or even any, costs to retool existing capping equipment to do so.

SUMMARY OF THE INVENTION

In one embodiment, a closure includes a top panel and a skirt extending generally perpendicular to the top panel. A plurality of raised ridges are formed about an outer surface of the skirt. Each of the ridges extends along the closure from a lower end located on a lower portion of the skirt. The closure also includes a plurality of knurls. Each knurl extends outwardly from an outer surface of a ridge.

In one embodiment, a closure includes a ring-like structure centered about a vertically extending axis. A plurality of protrusions are spaced about and extend radially outwards from and parallel to the vertical axis along an exterior surface of the structure. Each protrusion extends in a lengthwise direction along the vertical axis. Each protrusion is defined by a generally semi-circular cross-section as taken along a horizontally extending plane. A nub extends parallel to the vertical axis and outwards from an outer surface of each protrusion.

In one embodiment, a method of applying a closure to a container includes providing a closure. The closure includes an annular structure centered about a vertical axis. At least one projection parallel to the vertical axis extends radially outward from an outer surface of the annular structure. The outer surface of each projection is defined in horizontal direction by at least a first section, a second section, and a third section. The second section is located between the first section and the third section.

The first section is defined by a curve having a first radius of curvature. The second section is defined by a curve having a second radius of curvature. The third section is defined by a curve having a third radius of curvature. The first radius of curvature is larger than the second radius of curvature. The third radius of curvature is the same as the first radius of curvature.

A capping chuck having a serrated interior surface defined by a plurality of teeth is provided. The number of teeth forming the serration is greater than the number of projections. The closure is applied to a container using the chuck.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
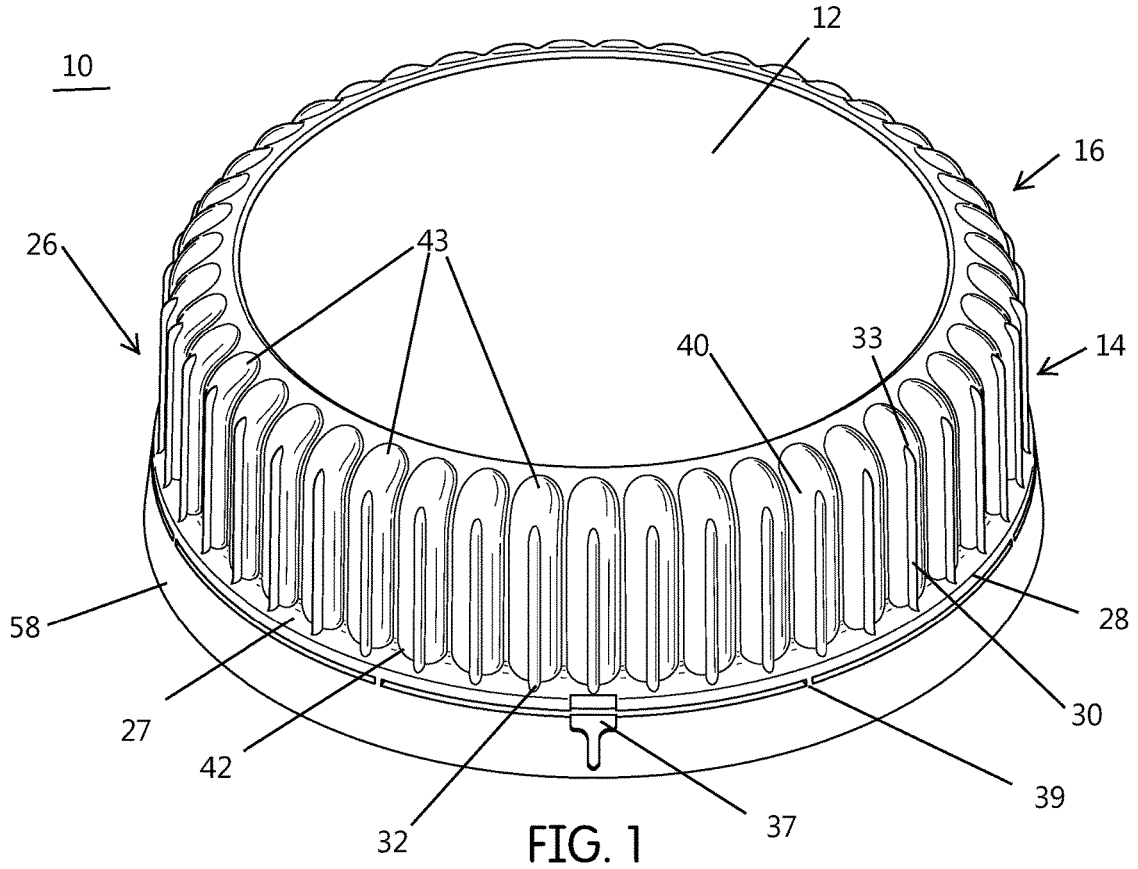
FIG. 1 shows a top perspective view of a closure according to an exemplary embodiment.

Referring to FIG. 1, a closure 10 is depicted according to an exemplary embodiment. The closure 10 includes a top panel or top portion, shown as a top wall 12. As shown in FIG. 1, the top wall 12 is generally circular and is generally planar (i.e., the outer surface of the top wall 12 is flat, lying substantially in a single plane). Extending downwards from top wall 12 is an annular skirt 14. An outwardly curved transition portion, shown as corner section 16 extends between the outer periphery of the top wall 12 and the uppermost edge of the annular skirt 14.

Figure 2:
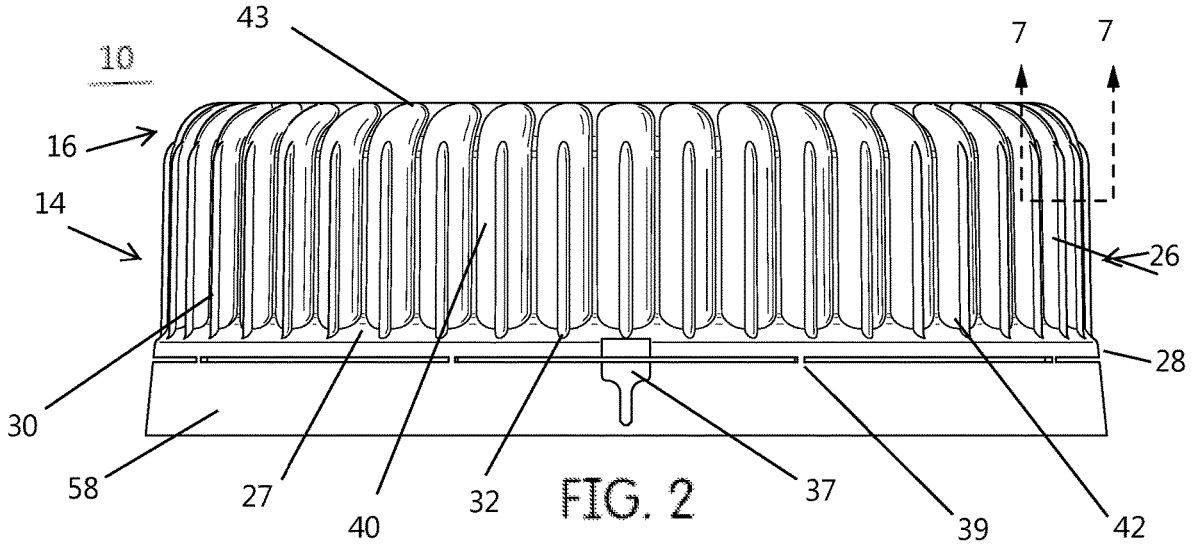
FIG. 2 shows a side view of the closure of FIG. 1 according to an exemplary embodiment.

As illustrated in FIG. 2, in one embodiment skirt 14 includes an upper section 26, a lower section 28, and an angled section 27 extending between upper section 26 and lower section 28. As shown in FIG. 2, upper section 26 of skirt 14 is generally circular in cross-section and is substantially perpendicular to the plane defined by top wall 12. Angled section 27 is a generally frustoconical section extending downwardly and outwardly from the lowermost edge of upper section 26, and lower section 28 extends downwardly from the lower edge of angled section 27 substantially perpendicular to the plane defined by top wall 12. As shown in FIG. 2, the radius of lower section 28 is greater than the radius of either top wall 12 or upper section 26 of skirt 14 such that lower section 28 extends radially outwards from upper section 26 and top wall 12.

In one embodiment, as illustrated e.g. in FIG. 2, the closure 10 may optionally include a tamper evidencing structure, such as tamper evident band 58 extending downwardly from the lower edge of the lower section 28 of skirt 14. The tamper evident band 58 includes frangible connecting elements 39 coupling the tamper band 58 to the lower section 28 of skirt 14. Upon application of twisting force to the closure 10, the frangible connecting elements 39 are configured to break, separating the tamper evident band 58 from the closure 10. Thus, the tamper evident band 58 provides a visual indication to the user of whether the closure 10 has previously been removed from a container 100 to which it is attached.

As illustrated in the embodiment of closure 10 shown in FIG. 2, the closure 10 may include locating features or pull-up marks 37 located along the outer surface of the skirt 14. The pull-up marks 37 identify the position of the threading 60 located along the inner surface of the closure 10 and provide an indication of alignment of the closure 10 as may be needed during various processes (e.g., handling, filling of the container, capping, etc.). For example, the pull-up marks 37 act as a visible feature allowing for evaluation and inspection of closure-to-container thread interaction.

Figure 3:
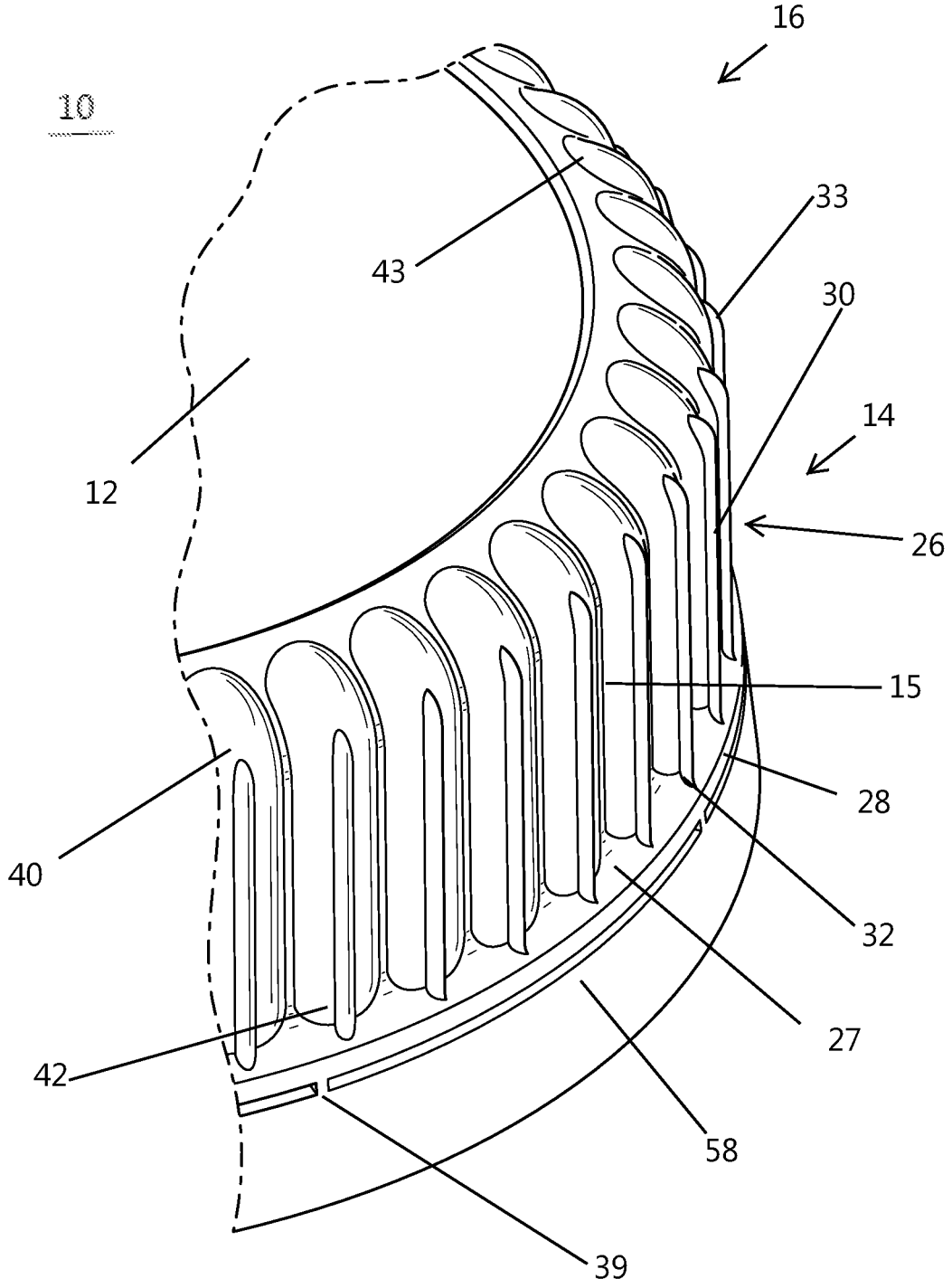
FIG. 3 shows an enlarged, top perspective view of the closure of FIG. 1 according to an exemplary embodiment.

Referring to FIG. 3, located along and extending outwards from the outer surface of closure 10 are a plurality of knurls 30 or other nubs, etc. and a plurality of ridges 40 or other protrusions or projections, etc. As will be described in more detail below, the size, shape, configuration, arrangement, and spacing of knurls 30 and ridges 40 are configured to allow for easier opening of a container 100 sealed by closure 10.

As illustrated, e.g. by the embodiment of FIG. 2, the outer surface of each ridge 40 defines a gentle curve that extends generally symmetrically radially outwards in a circumferential distance along the outer surface of the closure 10. As shown in FIG. 2, in one embodiment, each ridge 40 extends along a height of the closure 10 from a lowermost end 42 located on the angled section 27 of skirt 14 to an uppermost end 43 which terminates on the corner section 16 proximate the outer periphery of top wall 12.

Ridges 40 extend upwards and generally parallel to upper section 26 of the skirt 14, and extend along the corner section 16 along a curve that generally matches the curvature of corner section 16. By extending the length of the ridges 40 such that ridges 40 extend along the corner section 16, the ridges 40 are able to absorb energy that may be imparted to the closure 10 by contact with an object (e.g., another container or equipment during processing or shipment) or with a surface, such as the ground or floor, if the container having the closure 10 drops or falls, and thereby provide improved impact resistance to the closure 10. However, it is to be understood that in other embodiments (not shown), the uppermost ends 43 may terminate at other locations along the closure 10, such as, e.g. along the upper section 26 of closure or on the top wall 12.

As shown in FIG. 2, in one embodiment the terminal portions of uppermost end 43 of each ridge 40 may define a semispherical, rounded structure. In other embodiments (not shown), the terminal portion of each ridge 40 may define any other number of configurations, such as, e.g. a blunt, straight structure having a flat terminal surface, a tapered structure, etc. Also, although in the embodiment illustrated in FIG. 2 each of the ridges 40 are formed having the same rounded/curved configuration, in other embodiments, the configuration, structure, shape, size, etc. of the plurality of ridges 40 may be varied, and the closure may include any number of and/or any combination of shapes and structures of ridges 40.

Ridges 40 may be molded integrally with the skirt 14, such that the skirt 14 and ridges 40 form a monolithic structure. In other embodiments, ridges 40 and skirt 14 may be formed separately. The ridges 40 and skirt 14 may be formed from the same material or may be formed from different materials.

Figure 4:
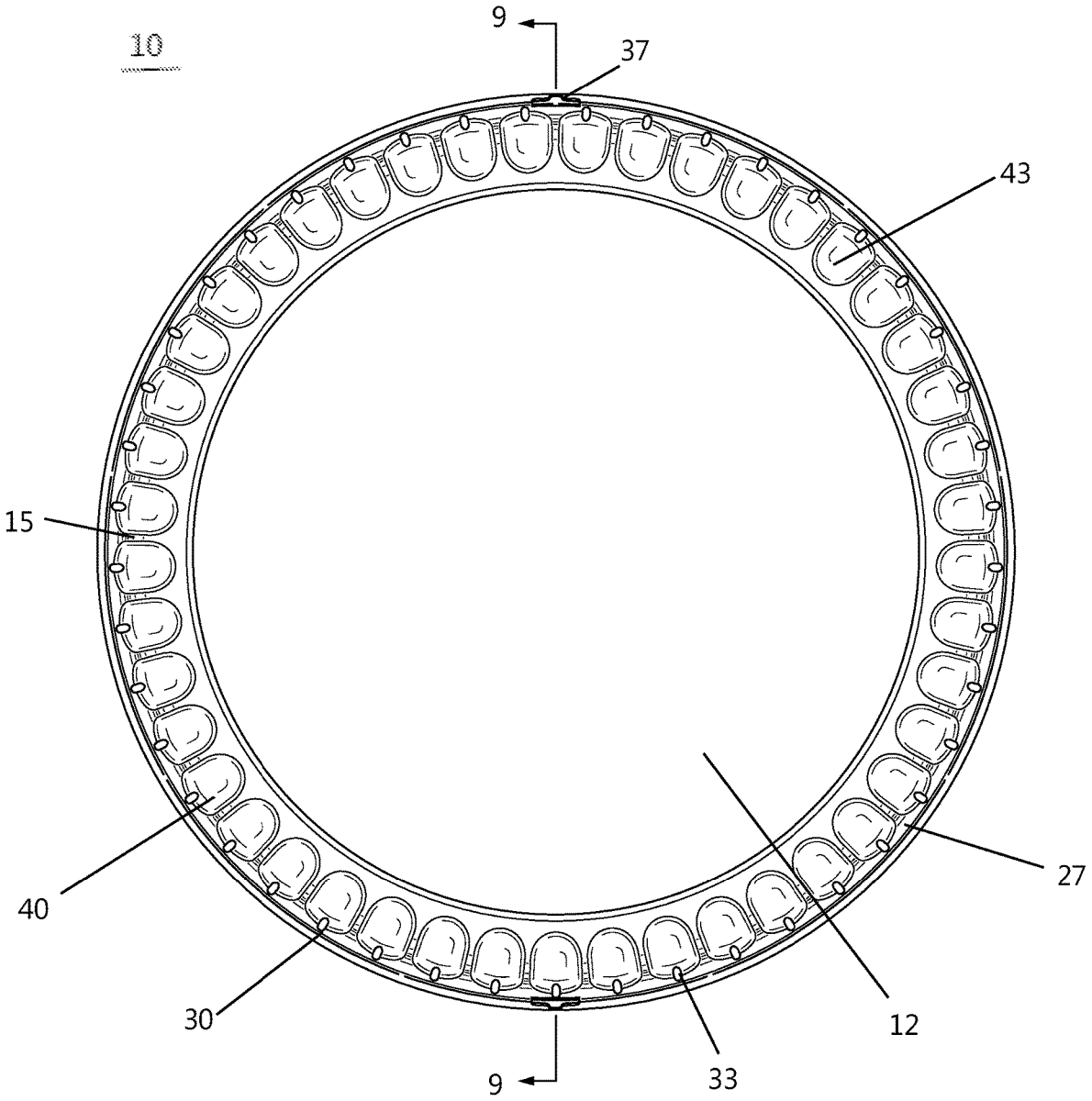
FIG. 4 shows a top view of the closure of FIG. 1 according to an exemplary embodiment.

As illustrated in FIG. 4, ridges 40 are spaced generally evenly about the circumference of the closure 10. In one embodiment, such as e.g. that illustrated in FIG. 4, adjacent ridges are separated from each other by sections 15 defined by the outer surface of the skirt 14. However, in other embodiments (not shown), ridges 40 may be formed and spaced about closure 10 with the left and right edges of adjacent ridges 40 abutting one another such that there are no empty sections 15 between adjacent ridges 40.

Referring to FIGS. 3 and 4, located generally along the midpoint of each ridge 40 is a knurl 30. As illustrated in FIG. 3, knurls 30 extend along a height of the closure 10 in a direction generally parallel to the upper portion 26 of skirt 14 upwards from a lowermost end 32 located on the angled portion 27 of skirt 14. Referring to FIG. 3, in one embodiment, each knurl 30 terminates at an uppermost end 33 located on or near the boundary between the skirt 14 and the corner section 16. In some embodiments, the terminal end of each knurl 30 may be located on the corner section 16 at a location immediately proximate the boundary between the skirt 14 and corner section 16. In other embodiments, the terminal end of each knurl 30 may be located on the skirt 14 at a location immediately proximate the boundary between the skirt 14 and corner section 16.

Figure 5:
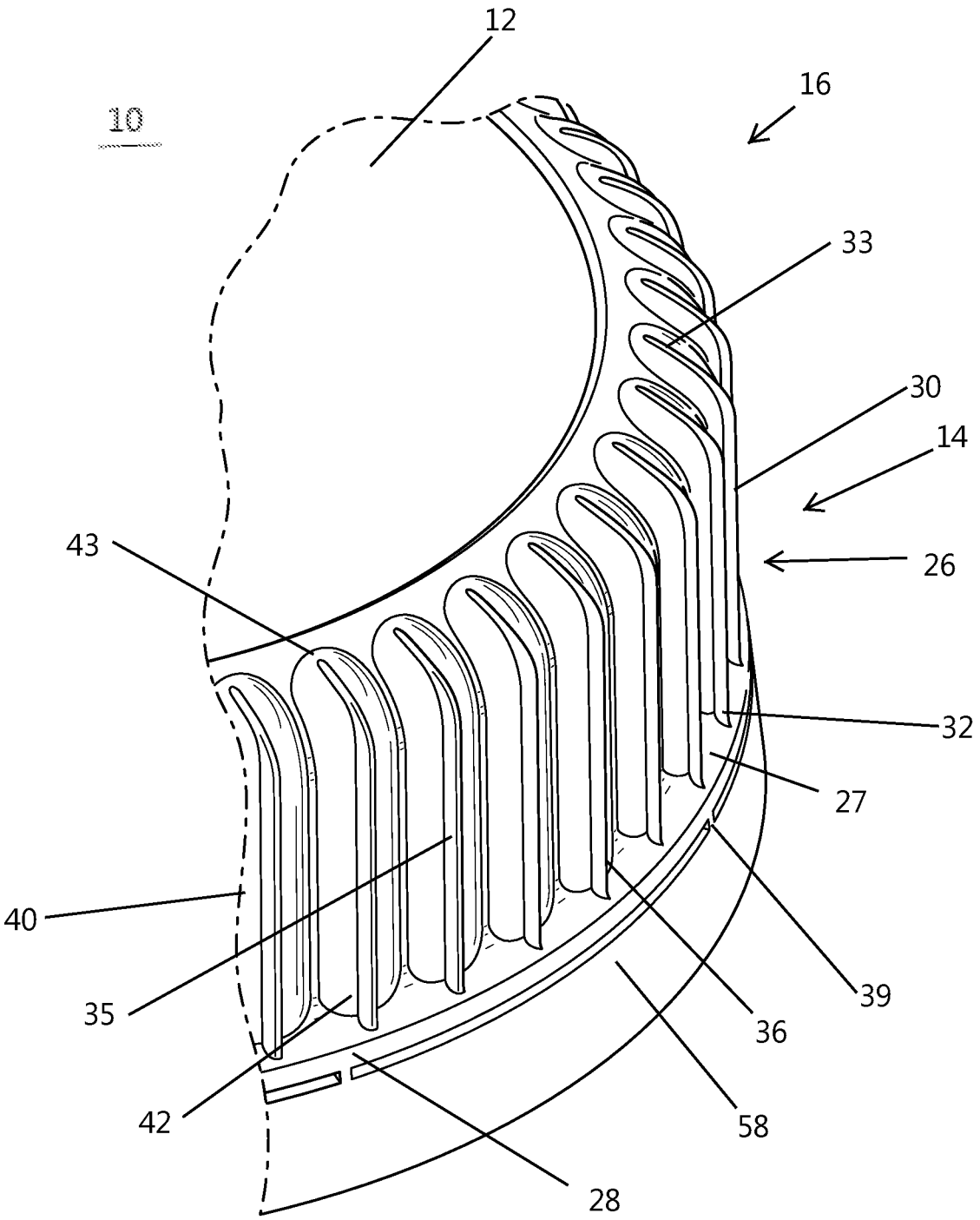
FIG. 5 shows an enlarged, top perspective view of a closure according to an exemplary embodiment.

As illustrated in FIG. 5, in one embodiment, knurls 30 may extend along a majority or the entirety of the ridges 40 such that the uppermost ends 33 of knurls 30 terminate at a location on the corner section 16 proximate the outer periphery of top wall 12, similar to the location of the uppermost ends 43 of ridges 40. In other embodiments (not shown) locations of the uppermost ends 33 of individual knurls 30 formed on the closure 10 may be varied such that the uppermost ends 33 of different knurls 30 of the closure 10 terminate at different locations along the height of the closure 10.

Figure 6:
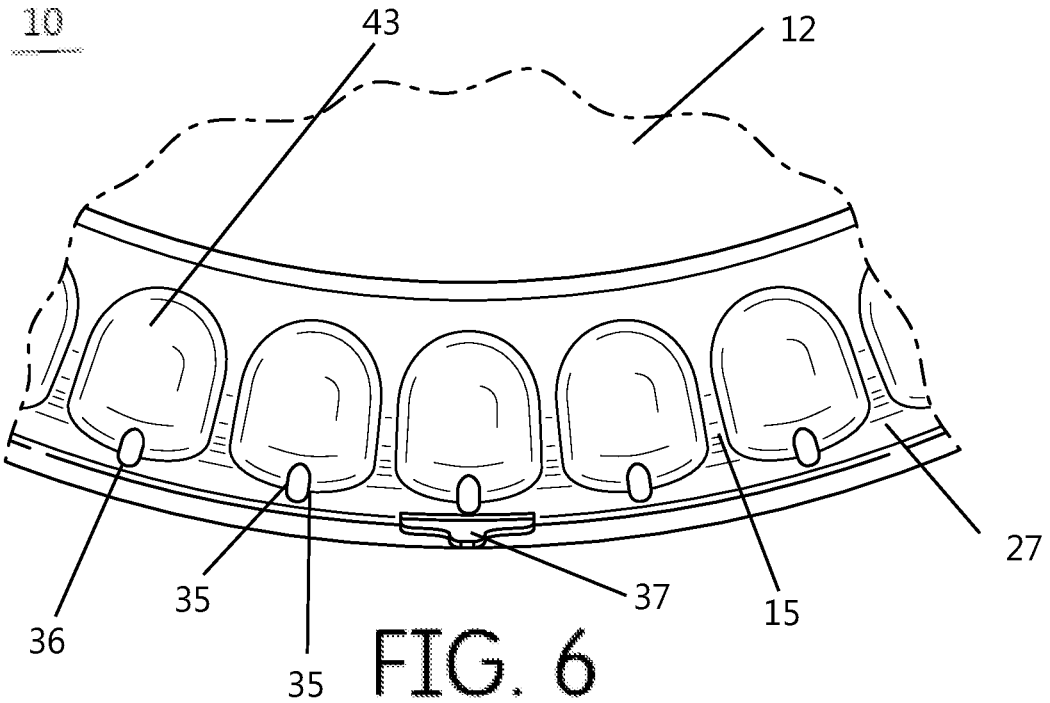
FIG. 6 shows an enlarged, top view of the closure of FIG. 1 according to an exemplary embodiment.

Each knurl 30 extends generally symmetrically in a circumferential direction along the outer surface of the closure 10. As shown in FIG. 6, each knurl 30 is formed having first and second sides 35 that extend radially outwards from ridge 40. The outermost ends of the first and second sides 35 forming each knurl 30 are connected by a terminal outer surface 36. As illustrated in FIGS. 3 and 6, in one embodiment first and second sides 35 and the terminal outer surfaces 36 of knurls 30 may be curved.

Figure 7:
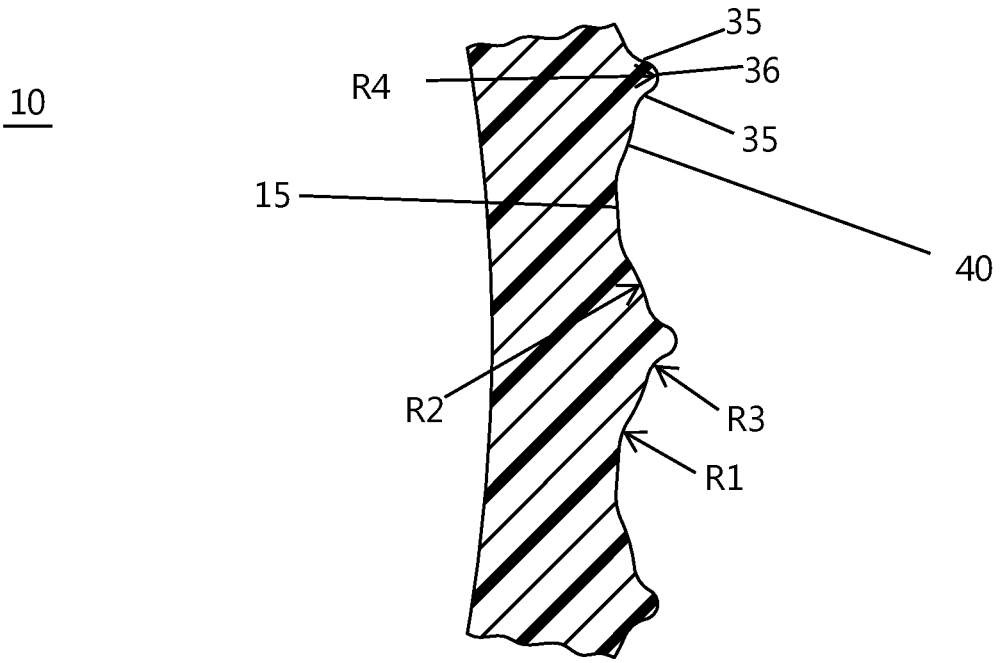
FIG. 7 shows an enlarged cross-section of the closure of FIG. 1 as taken along line 7-7 of FIG. 2 according to an exemplary embodiment.

The curvature of outer surfaces of ridges 40, the first and second sides 35 of knurl 30 and the terminal outer surface 36 of knurl 30 according to one embodiment are illustrated in FIGS. 2 and 7. Shown in FIG. 7 is a cross-sectional view of an embodiment of closure 10 as taken along line 7-7 of FIG. 2. The closure 10 of the embodiment of FIG. 2 is a 43 mm closure (as defined between the radially outermost portions of the terminal outer surfaces 36 of knurls 30). As shown in the view of FIG. 4, the closure 10 comprises forty-five ridges and knurls spaced generally evenly about the closure 10, such that the midpoints of adjacent knurls 30/ridges 40 are spaced approximately eight degrees from one another as measured from the center of the closure 10. In another embodiment (not shown), closure 10 may comprise a 38 mm closure formed with thirty-two ridges and knurls.

As shown in FIG. 7, in one exemplary embodiment the radius of curvature R1 of the curve extending between sections 15 of the skirt 14 extending between adjacent ridges 40 and the outer surface of ridge 40 is between 0.020 and 0.050 inches, and more specifically 0.030 inches. The radius of curvature R2 of the outer surfaces of knurls 40 is between 0.050 and 0.100 inches, and more specifically 0.073 inches. The radius of curvature R3 defining the outer surfaces of the sides 35 of knurls is between 0.005 and 0.020 inches, and more specifically 0.012 inches. The radius of curvature R4 defining the terminal outer surface 36 of knurls 30 is between 0.005 and 0.010 inches, and more specifically 0.007 inches.

Figure 8:
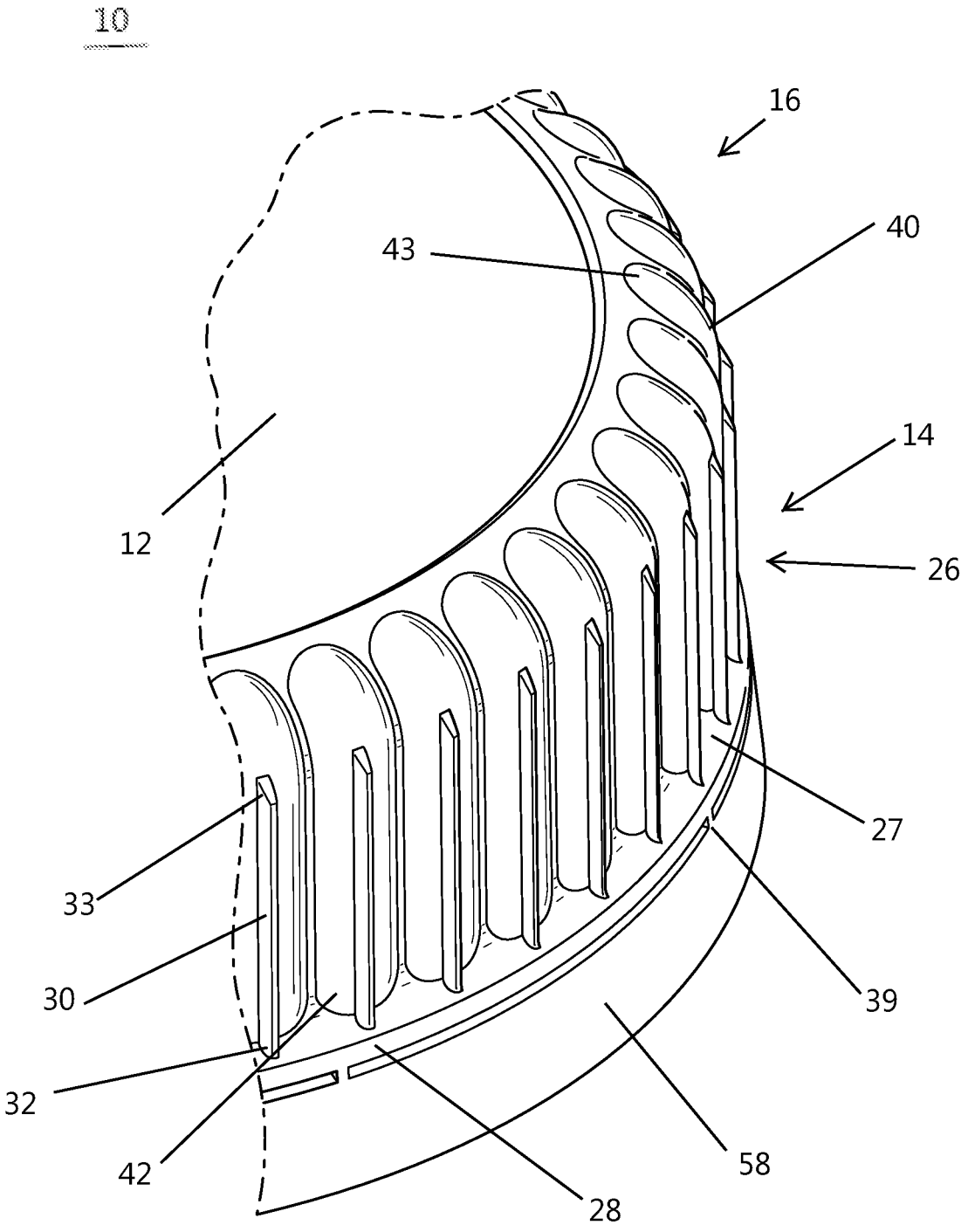
FIG. 8 shows an enlarged, top perspective view of a closure according to an exemplary embodiment.

In other embodiments, such as, e.g. the embodiment illustrated in FIG. 8, first and second sides 35 and the outer surfaces 36 of knurls 30 may be formed by flat, planar surfaces that intersect one another at sharp angles. In yet other embodiments (not shown), the cross-sections of knurls 30 may be formed having any other number of and any combination of shapes including but not limited to triangular, rectangular, or trapezoidal.

Referring to FIG. 1, in one embodiment, a knurl 30 is formed on each ridge 40. However, in other embodiments (not shown), knurls 30 are formed on only some of the ridges 40. For example, knurls 30 may be formed on every other, or on every third ridge 40. Knurls 30 may be molded integrally with skirt 14, such that the knurls 30 and ridges 40 and/or the knurls 30, ridges 40, and skirt 14 form a monolithic structure. In other embodiments, knurls 30 and ridges 40 may be formed separately. The knurls 30, ridges 40 and skirt 14 may be formed from the same material or may be formed from different materials.

As noted above, a closure 10 having an outer surface formed with knurls 30 and ridges 40 as described above and as shown in the various embodiments of FIGS. 1-8 provides the closure 10 with improved opening characteristics. The knurls 30 that extend radially outwards from ridges 40 make it easier for the user to grip the closure 10 and apply a sufficient torque to twist off/twist on the cap 10 from/to a closure 100.

The smooth, larger dimensioned ridges 40 provide a large, ergonomic surface area for a user to grasp and apply pressure to when opening a container 100 closed by the closure 10. In addition to providing increased impact resistance to the closure 10, by extending the ridges 40 along the corner section 16 and towards the top wall 12 of the closure 10, the gripping surface area of the closure 10 is increased. By providing gripping surfaces on the upper surface of the closure 10, even individuals having insufficient hand strength, flexibility and/or size, or any other individuals for whom it would be difficult to close their fingers/wrap their hand around the outer perpendicular skirt 14 portion of closure 10, are provided a gripping surface (i.e. the portion of ridges 40 extending about corner section 16) to which force and pressure may be transmitted to effectuate twist-off of the closure 10 from a container 100.

In addition to providing an enhanced feel and ease of grip for twist on/twist off of the closure, the size, shape, configuration, arrangement, and spacing of knurls 30 and ridges 40 allow the closure 10 to be used interchangeably with conventional ribbed closures using existing capping machines, without requiring the modification, retrofitting or replacement of any of the parts of the capping equipment. Thus, for reasons as described in more detail below, closures 10 having enhanced ergonomic and opening features as described herein may easily replace conventional ribbed closures with minimal or no expenditure of time, effort or money to do so.

Conventional closures may include ribbed outer skirt portions to provide somewhat of a gripping surface to allow twist-on and twist-off of the conventional closure to a container. In order to minimize user discomfort during twist-off, adjacent ribs on conventional closures are spaced close to one another in a circumferential direction, resulting in the number of ribs being formed on the conventional closure being relatively high. For example, a conventional 38 mm closure may be formed with ninety-six ribs, and a conventional 43 mm closure may be formed with 135 ribs. As a result of the large number of ribs formed on such conventional closures, a relatively larger quantity of materials are required to form the closures, adding both to the weight of and the cost of manufacturing the conventional closures.

The ribs of the outer surface of the skirt of a conventional closure may also be utilized in the capping process. The application of closures to containers is often performed using a chuck capping machine having a chuck that holds and rotates the closure onto a container. During the capping process it is important that the chuck can apply sufficient torque to properly thread or affix the closure to the neck of the container. In order to provide the required torque, the inner surface of the chuck used to apply the conventional closures may be formed with teeth or serrations that match and fit in between the ribs of the conventional closure.

Because the shape, spacing, dimensions and other configurations of the teeth of the chuck must correspond substantially identically to the ribbing of the conventional closure to ensure proper interengagement of the chuck with the closure, a chuck is typically formed for use only with a single, specific closure design. Given the precision engineering and machining required to manufacture a chuck that will properly match the ribbing of the specific closure ribbing, the costs, time and effort required to produce a chuck for use with a particular conventional closure design are relatively high. As such, once a chuck specific to a closure design has been provided, it is often financially unfeasible to modify the closure design.

Unlike existing conventional closures, a closure 10 as shown and described according to any of FIGS. 1-8 can easily substitute a conventional closure in a capping process without requiring retooling of the capping chuck. The following describes a process according to one embodiment of designing a closure 10 being lighter than and having an improved grip and feel as compared to a conventional closure that can be interchanged with conventional closures and which can be applied to containers using existing capping chucks.

As noted above, a closure 10 having a desired diameter may be formed with any number and spacing of ridges 40 and knurls 30, as dictated by design. In order to provide a closure 10 interchangeable with a conventional closure for which a chuck has been machined, the outer diameter of the closure 10, as defined between the outermost surfaces of knurls 30, is first modified to match the outer diameter of the conventional closure as defined between the outermost surfaces of ribs//corresponding inner diameter of the chuck.

The number of knurls 30 and ridges 40 on the closure 10 is then chosen to correspond to the largest whole number that is ⅓, ¼, or ⅕ the number of ribs on the conventional closure. For example, a conventional closure having ninety-six ribs would result in closure 10 having thirty-two knurls 30; a conventional closure having a hundred ribs would correspond to a closure 10 having twenty-five knurls; a conventional closure having 105 ribs would correspond to a closure 10 having thirty-five knurls 30; a closure having 110 ribs would correspond to a closure having twenty-two knurls 30.

Once the number of knurls 30 has been determined, the ridges 40 and knurls 30 are positioned evenly about the outer perimeter of closure 10, with the locations of knurls 30 along the perimeter of closure 10 corresponding to the position of ribs along the outer perimeter of the conventional closure. The outer configuration (i.e. shape, width, etc.) of the knurls 30 is also designed to generally correspond to that of the ribs of the conventional closure. In such a manner (i.e. with the general configuration of the knurls 30 matching that of the ribs and the location of knurls 30 about the closure 10 corresponding to locations about the conventional closure at which ribs extend) the knurls 30 formed on closure are configured to fit within the existing serrations or teeth formed on the chuck that was specifically designed to match the ribbing of the conventional closure. As the knurls 30 fit within these serrations, the chuck is able to impart a sufficient torque onto the closure 10 to properly apply the closure 10 to the neck of a container 100 during the capping process.

As described above, in one embodiment of providing a closure 10, the diameter, number of knurls 30 and ridges 40 and the configuration of knurls 30 is chosen based on a conventional closure (and corresponding chuck) which the closure 10 is intended to replace in the capping process in order to provide a lighter closure 10 having improved gripping and opening characteristics. However, it is to be understood that in other embodiments, the diameter, number of knurls 30 and ridges 40, and the configuration of knurls of the closure 10 can be chosen/designed first, with a corresponding chuck being formed subsequently to and specific/matched to the design of the closure 10.

Figure 9:
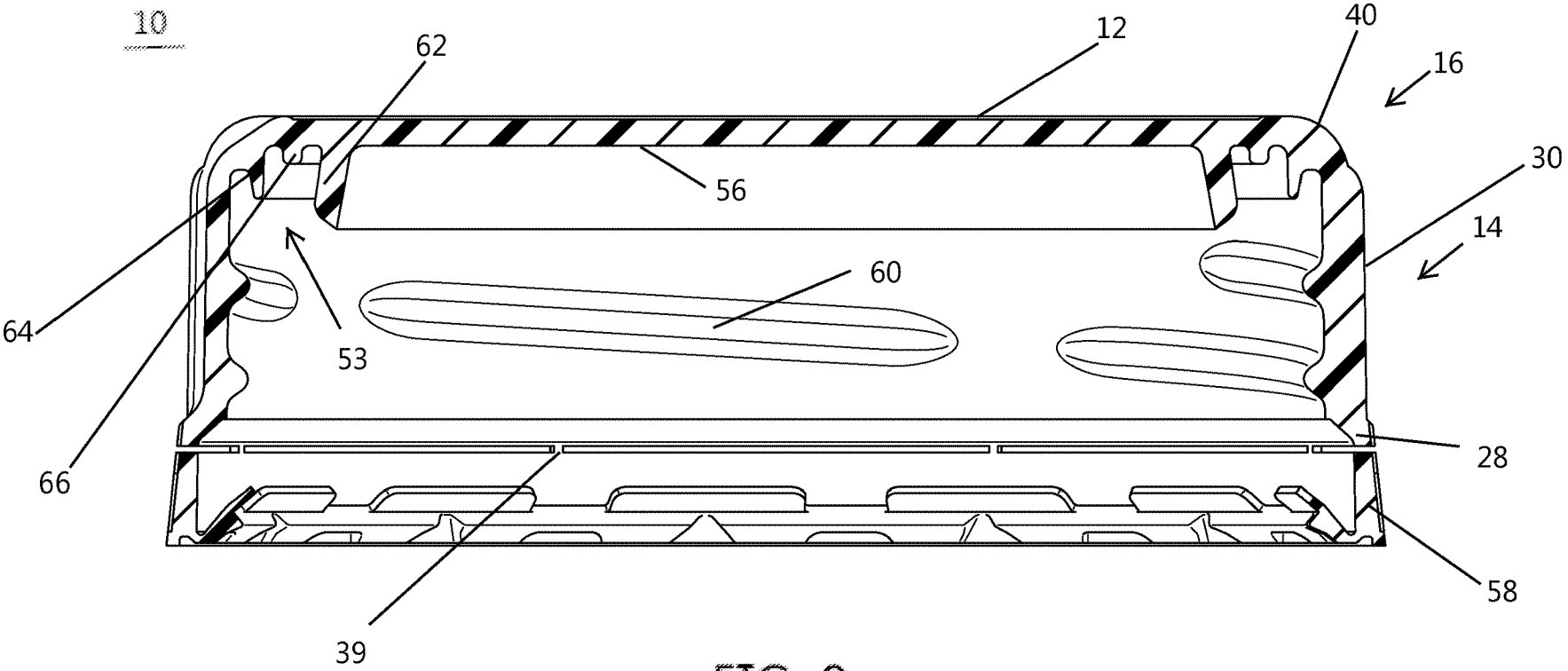
FIG. 9 shows a cross-section of the closure of FIG. 1 as taken along line 9-9 of FIG. 4 according to an exemplary embodiment.
Figure 10:
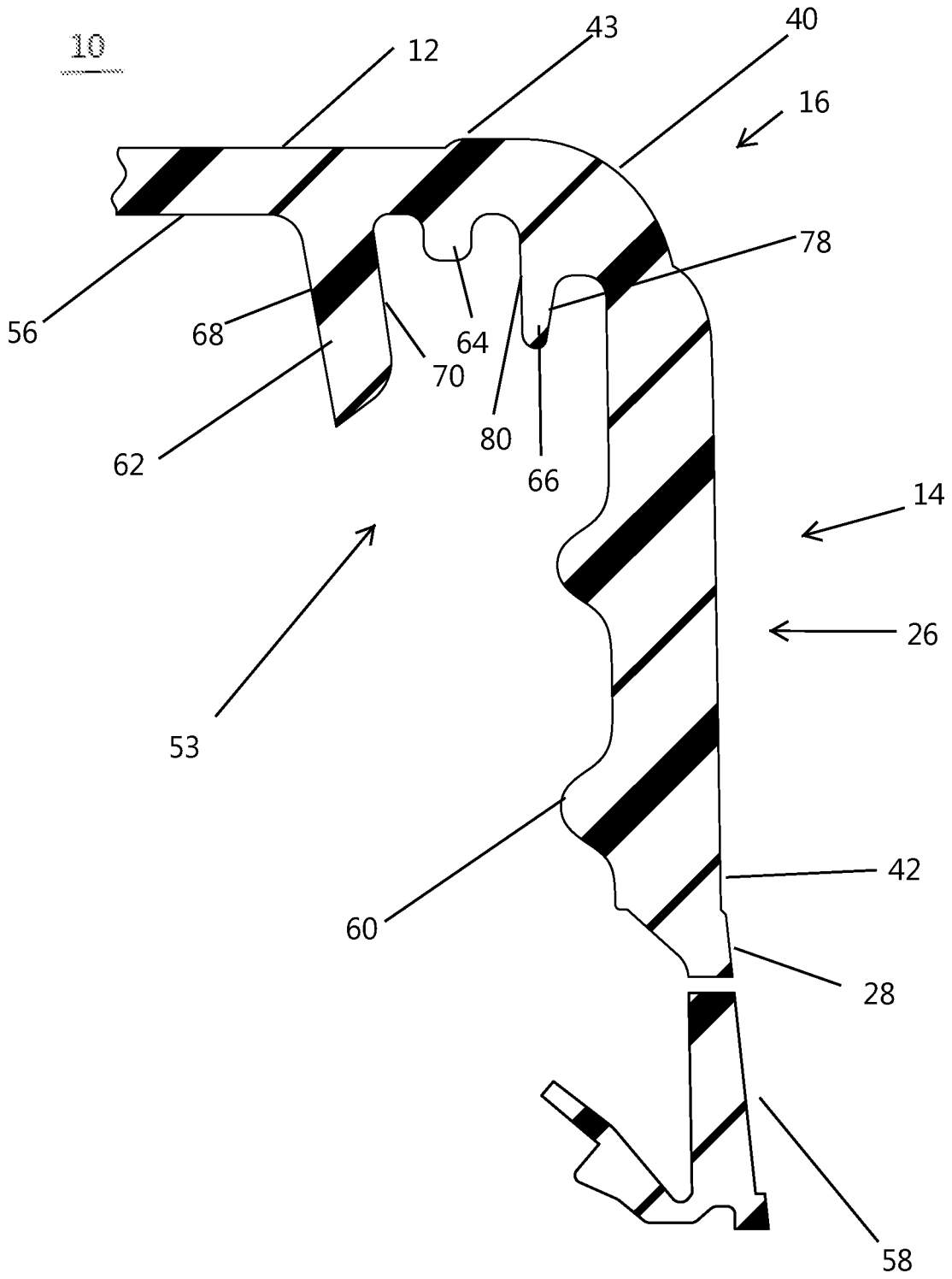
FIG. 10 shows an enlarged cross-section of an outer periphery of the closure of FIG. 1 according to an exemplary embodiment.
Figure 11:
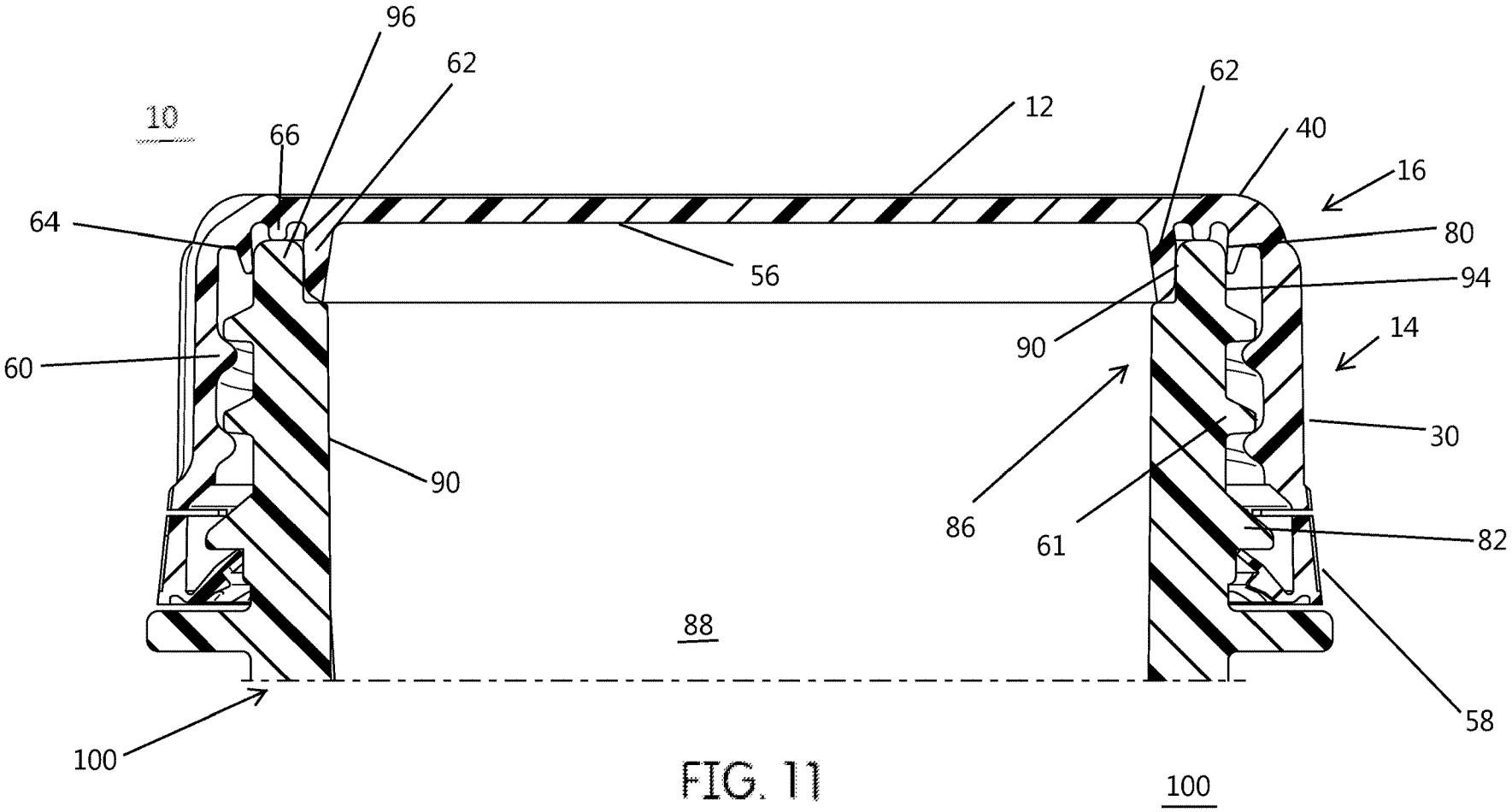
FIG. 11 shows a cross-section of the closure of FIG. 1 according to an exemplary embodiment attached to a container according to an exemplary embodiment.

The interior surfaces and features of the closure 10 (e.g. container attachment, sealing member, liner, etc.) may be varied as desired and as needed. Referring to FIGS. 9-11, the following description made in reference to these figures provides a description of an inner surface sealing arrangement and engagement element which is just one of a number of embodiments of an inner surface configuration which is useable with the closure 10 outside surface structure described in reference to FIGS. 1-8.

Referring to FIG. 9, a cross-sectional view of closure 10 which illustrates the profile of the multi-seal area/portion 53 in the interior of the closure 10 is shown. The closure 10 includes a circular, top panel 12 having an internal surface 56. Cylindrical skirt 14 extends from the top panel 12 to a tamper band 58 attached thereto. The interior of skirt 14 includes a thread 60 for engaging a corresponding thread 61 on a container (shown in FIG. 11).

The seal portion 53 includes an inclined seal ring 62 extending from the internal surface 56 and concentric with the skirt 14. A vertical seal ring 64 extends from the internal surface 56 between the inclined seal ring 62 and the skirt 14 and is concentric with the skirt 14. A top-edge seal ring 66 extends from the internal surface 56 between the inclined seal ring 62 and the vertical seal ring 64. The inclined seal ring 62 extends further from the internal surface 56 than the vertical and top-edge seal rings 64, 66, and vertical seal ring extends further from the internal surface 56 than the top-edge seal ring 66.

The inclined seal ring 62 includes a flat wall 68 facing away from the skirt 14 at a greater than 90° angle and a seal wall 70 facing toward the skirt 14. In one embodiment, the flat wall 68 may extend from the internal surface 56 at an angle of about between 95 and 115 degrees. The seal wall 70 is configured to create a seal with an associated container 100 (see FIG. 11).

The vertical seal ring 64 includes a wall 78 facing toward the skirt 14 and a seal wall 80 facing away from the skirt 14. The seal wall 80 creates a second seal between the closure 10 and an associated container 100.

As shown in FIG. 11, the closure 10 may be coupled to a container 100. In this embodiment, the container 100 includes a neck portion 86 that is open at the top end. The neck portion 86 includes threading 61. The closure 10 is coupled to the neck portion 86 via engagement between the threading 60 of the closure 10 and the threading 61 of the container 100 to seal or close the neck portion 86. While not shown in FIG. 11, the container 100 also includes a body sidewall and an end wall at the lower end of the body sidewall such that the container 100 is capable of holding material within an interior chamber 88 of the container 100. The container 100 may be any container that is sealed by a closure, such as the closure 10, and the container 11 may be suitable for holding a variety of contents including food, drink, etc., within the chamber 88.

Referring again to FIG. 11, the operation of the multi-seal area 53 can be discussed. In particular, when closure 10 is fully engaged with container 100, a seal is formed between the internal wall 90 of neck portion 86 and inclined seal ring 62. A second seal is formed between the seal wall 80 of vertical sealing ring 64 and an outer wall 94 of neck portion 86. A third seal is formed between top-edge seal ring 66 and seal surface 96. The three seals are formed by the pressure created at the rings by the threading 60 of closure 10 onto container 100 which also causes at least rings 62 and 64 to deflect away from neck portion 86 during sealing.

Additionally, when closure 10 closes container 100, tamper band 58 folds up under a ridge 82 so that the tamper band 58 is deformed and/or damaged when closure 10 is removed from container 100. Stated differently, the closure design disclosed herein allows for a sequential opening of a container where the tamper band 58 is positioned and sized relative to the ridge 82 to break before all of the seals between closure 10 and container 100 are broken. Additionally, closure 10 can be used with a container where less than all 3 of the seals occur when the closure 10 is fully engaged with container 100. As such, closure 10 can be used with a number of different container neck portion configurations and for a number of different applications such as hot filling processes.

In various embodiments, the closures discussed herein may be formed from a plastic or polymer material. In various embodiments, the closures may be formed by injection molding or by compression molding. For example, the closures may be injection molded from a polypropylene homopolymer resin. In specific embodiments, the closures may be made from a clear (e.g., translucent or transparent) polypropylene homopolymer resin, or they may be made from a clear random copolymer polypropylene. In various embodiments, the clear material of the closure is such that the engagement structure (e.g., threading 60) is visible from the outside of the closure 10 through skirt 14.

In various embodiments, the closures discussed herein may be of various sizes intended to seal containers of various sizes and having various contents. In some exemplary embodiments, the closures are configured to seal containers such as metal, glass or plastic containers or bottles for holding liquids, granular materials, food, etc.

Further modifications and alternative embodiments of various aspects of the invention will be apparent to those skilled in the art in view of this description. Accordingly, this description is to be construed as illustrative only. The construction and arrangements of the closure, as shown in the various exemplary embodiments, are illustrative only.

Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein.

Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

What is claimed is:

1. A method of applying a closure to a container comprising:

providing a closure comprising:

an annular skirt centered about a vertical axis;

a plurality of projections each having an outer surface parallel to the vertical axis and extending radially outward from an outer surface of the annular skirt;

providing a capping chuck having a serrated interior surface defined by a plurality of teeth, wherein the number of teeth forming the serration is greater than the number of projections; and applying the closure to a container using the chuck.

2. The method of claim 1, wherein the number of teeth is three times greater than the number of projections.

3. The method of claim 1, wherein each projection has a terminal outer surface, and wherein a radius of curvature within a first section of the annular skirt is between 0.020 inches and 0.050 inches.

4. The method of claim 3, wherein a radius of curvature within a second section of the annular skirt is between 0.050 inches and 0.100 inches, and wherein the second section is closer to the terminal outer surface than the first section.

5. The method of claim 4, wherein a radius of curvature within a third section of the annular skirt is between 0.005 inches and 0.020 inches, and wherein the third section is closer to the terminal outer surface than the second section.

6. The method of claim 5, wherein a radius of curvature of the terminal outer surface is between 0.005 inches and 0.010 inches.

7. A method of applying a closure to a container comprising:

providing a closure comprising:

an annular skirt centered about a vertical axis; and a plurality of projections each having an outer surface parallel to the vertical axis and extending radially outward from an outer surface of the annular skirt, wherein each projection defines a terminal outer surface, a first section, a second section, and a third section, the third section being closer to the terminal outer surface than the second section, and the first section being closer to the terminal outer surface than the second section;

providing a capping chuck having a serrated interior surface defined by a plurality of teeth, wherein the number of teeth forming the serration is greater than the number of projections, wherein the second section of each projection has a first width as measured along a circumferential direction of the closure and adjacent teeth define a second width as measured along a circumferential direction of the chuck, and wherein the first and second widths being substantially the same such that each of the second sections is configured to be located in between adjacent teeth of the chuck when the closure is positioned within the chuck; and applying the closure to a container using the chuck.

8. The method of claim 7, wherein the closure further comprises a generally horizontally extending sealing element located between a top and bottom of the structure.

9. The method of claim 8, wherein a width of the first section as measured in a circumferential direction is greater than the first width of the second section.

10. The method of claim 9, wherein a width of the third section as measured in a circumferential direction is equal to the width of the first section.

11. The method of claim 10, wherein the chuck is formed with 135 teeth and the closure is formed with forty-five knurls.

12. The method of claim 11, wherein the knurls each have a midpoint and are spaced evenly about the closure, such that the midpoints of adjacent knurls are spaced 8 degrees from one another as measured from a center of the closure.

13. A method of applying a closure to a container comprising:

providing a closure comprising:

an annular structure centered about a vertical axis and having a top wall and an outer surface having a circumference;

a corner section proximate an outer periphery of the top wall;

a plurality of ridges spaced around the outer surface, each ridge comprising a knurl extending radially outwards from the respective ridge;

providing a capping chuck having a serrated interior surface defined by a plurality of teeth, wherein the number of teeth forming the serration is greater than the number of ridges; and applying the closure to a container using the chuck.

14. The method of claim 13, wherein each ridge extends along the corner section and towards the top wall.

15. The method of claim 14, wherein the plurality of ridges creates a gripping surface along the corner section.

16. A method of applying a closure to a container comprising:

providing a closure comprising:

a top wall;

a skirt extending downward from and perpendicular to the top wall having an outer surface having a circumference; and a plurality of ridges spaced around the circumference of the outer surface, each ridge comprising a knurl extending radially outwards from the respective ridge;

providing a capping chuck having a serrated interior surface defined by a plurality of teeth, wherein the number of teeth forming the serration is greater than the number of ridges; and applying the closure to a container using the chuck.

17. The method of claim 16, wherein the number of knurls and ridges ranges from ⅓ to ⅕ of the number of teeth.

18. The method of claim 17, wherein the knurls are located in a position corresponding to the ribs along an outer perimeter of the closure.

19. The method of claim 18, wherein each projection has a terminal outer surface, and wherein a radius of curvature within a first section of the annular skirt of at least 0.020 inches, and wherein a radius of curvature within a second section of the annular skirt is at least between 0.050 inches, and wherein the second section is closer to the terminal outer surface than the first section.

20. The method of claim 19, wherein the each knurl fits within a serration formed on the chuck.

* * * * *